United States Patent [19]

Koehm et al.

[11] 3,942,500

[45] Mar. 9, 1976

[54] FUEL SAVING SYSTEM AND APPARATUS FOR INTERNAL COMBUSTION ENGINES

[75] Inventors: Ronald E. Koehm, Ventura, Calif.; Dante Fabbri, Woburn, Mass.

[73] Assignees: Ronald E. Koehm, Ventura, Calif.; Dante Fabbri, Woburn, Mass.; I. Jordan Kunik, New York, N.Y. ; part interest to each

[22] Filed: Dec. 11, 1973

[21] Appl. No.: 531,471

Related U.S. Application Data

[63] Continuation of Ser. No. 362,095, May 21, 1973, abandoned.

[52] U.S. Cl. ..... 123/141; 48/180 R

[51] Int. Cl.[2] ..... F02M 31/00

[58] Field of Search ..... 123/141, 122 AC; 48/180 R

[56] References Cited

UNITED STATES PATENTS

| | | | |
|---|---|---|---|
| 1,420,616 | 6/1922 | May | 123/122 AC |
| 2,661,269 | 12/1953 | Briggs | 123/141 |
| 2,977,205 | 3/1961 | Austin | 123/141 |
| 3,847,125 | 11/1974 | Malherbe | 123/141 |

*Primary Examiner*—Charles J. Myhre
*Assistant Examiner*—R. H. Lazarus
*Attorney, Agent, or Firm*—I. Jordan Kunik

[57] ABSTRACT

The system and apparatus herein incorporate means for effectively removing significant quantities of liquid components from the fuel mixture while the latter passes from the carburetor to the intake manifold of an internal combustion engine, and for recovering said liquid components and recycling them through the fuel supply system in order to effect appreciable savings in fuel consumption during operation of the engine. The invention includes means for centrifuging liquid components from the fuel stream into an adjacent collection chamber whence said liquids move continuously into a drain tank which maintains a closed system with the collection chamber. The capture of liquids in the collection chamber may be improved by incorporating a reticular packing therein. Additional means are provided to restore a desired quantity of liquid fuel to the fuel stream when the engine requires temporary surge or demand power.

18 Claims, 16 Drawing Figures

FIG. 1
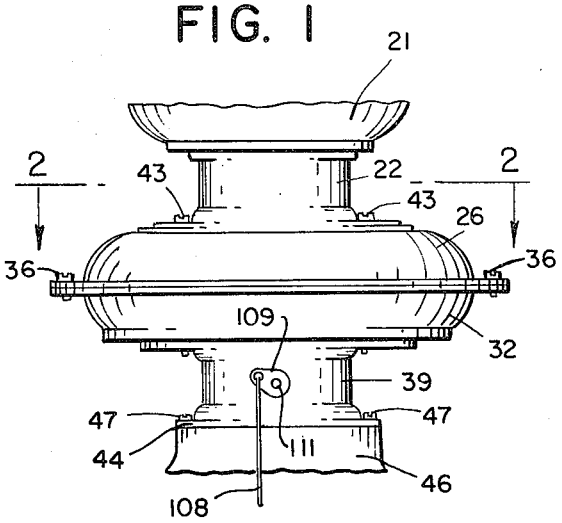
FIG. 2
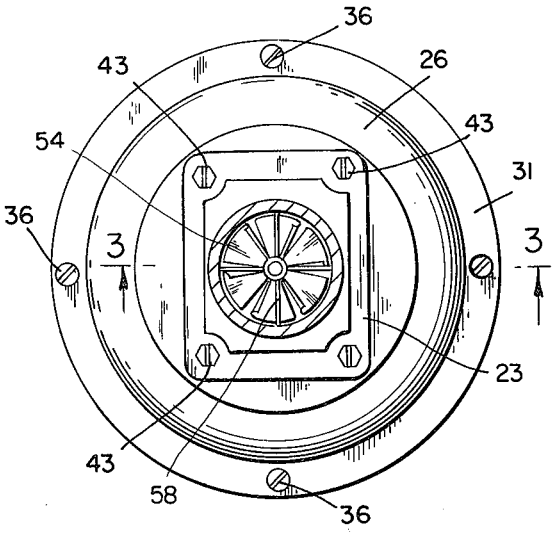
FIG. 3
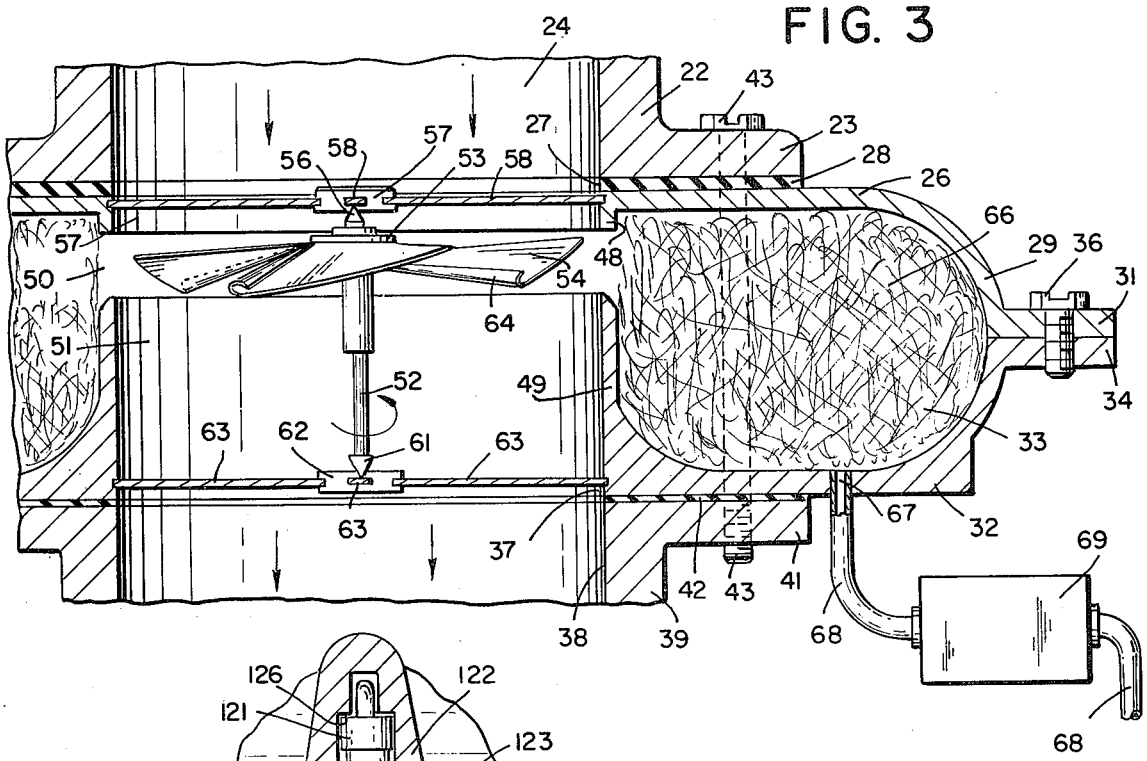
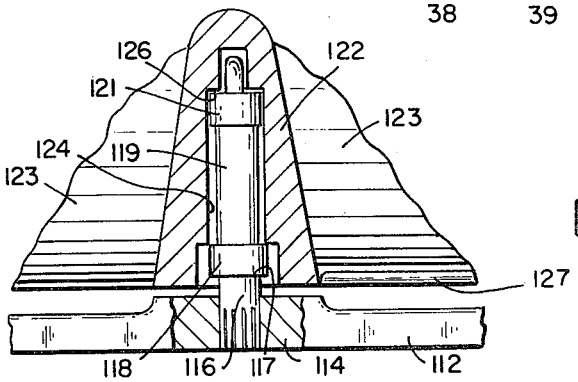
FIG. 6

FIG. 9
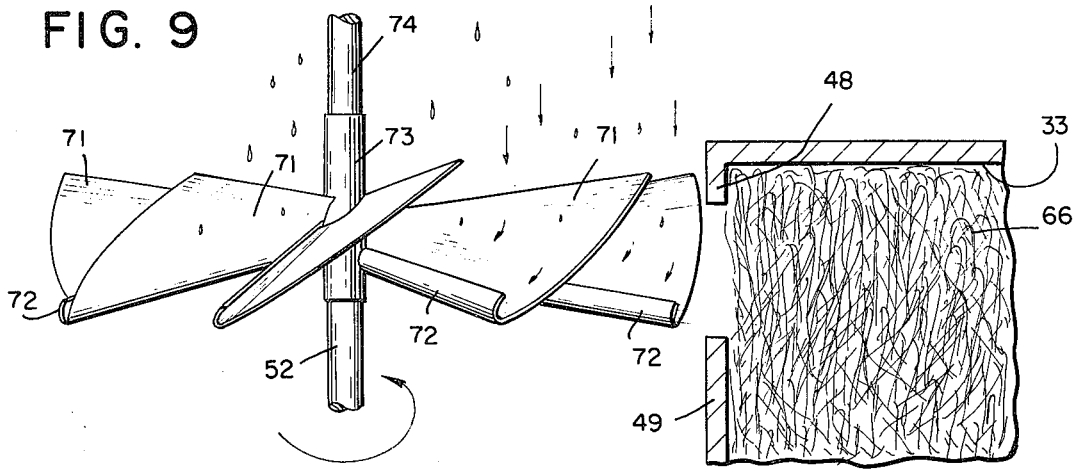
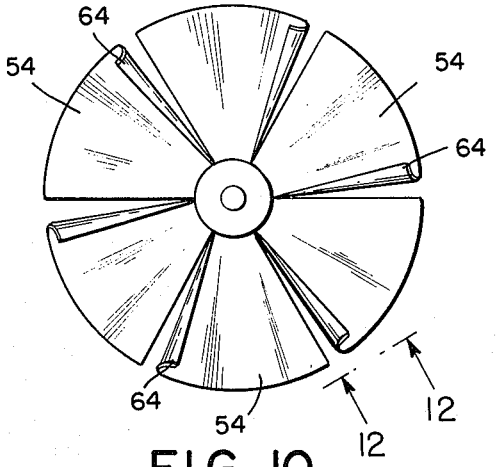
FIG. 10
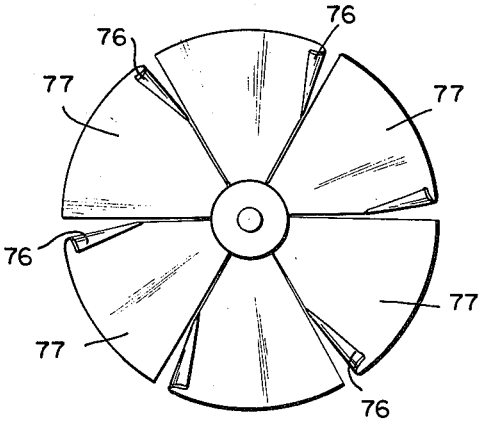
FIG. 11
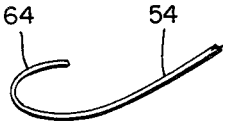
FIG. 12
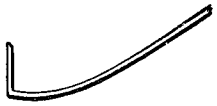
FIG. 12a
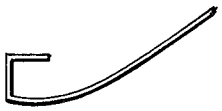
FIG. 12b
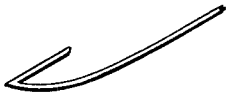
FIG. 12c
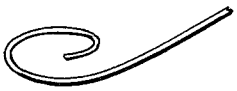
FIG. 12d

FUEL SAVING SYSTEM AND APPARATUS FOR INTERNAL COMBUSTION ENGINES

This is a continuation, of application Ser. No. 362,095 filed May 21, 1973 now abandoned.

BACKGROUND OF THE INVENTION

1. FIELD OF THE INVENTION

The present invention relates to fuel supply systems for internal combustion stationary or automotive engines, and more particularly to improved carburetor apparatus by which excess fluid fuel is withdrawn from the fuel stream that is being transmitted to the intake manifold of the engine. The apparatus herein comprises an improved propeller located in the path of the fuel stream, the force of which, impinging upon the propeller blades, causes the passive rotation thereof. The blades of the propeller have trailing edge scoops or flanges which capture or collect liquid components from the fuel stream and centrifugally propel said components into an annular collection chamber or trap. The chamber contains a mass of reticular fibrous, webbed, porous or cellular material such as metal wool, filaments of natural or synthetic fiber, ceramic strands or masses, or combinations thereof which, by capillary action and by gravity and the like, cause the liquid to drain downward into a suitable well for collection or return to the main fuel supply tank.

2. DESCRIPTION OF THE PRIOR ART

Previous devices in the prior art have intended to reduce the liquid components in the fuel stream of internal combustion engines and these devices have comprised expansion chambers (U.S. Pat. No. 2,098,391), mixing fans for improving vaporization (U.S. Pat. No. 1,213,621), and a combination of these two concepts (U.S. Patent Reissue 20,885).

Whatever improvement may have been exhibited by the apparatus shown in said patents, it is believed that insufficient elimination of liquid fuel from the gas stream was realized to warrant an adequately viable apparatus to perform the desired end purpose of improving the operation of the engine and saving fuel. The propeller blades of the prior art were ineffective in projecting sufficient liquid fuel into the expansion chamber, and if the latter were empty of packing, the down draft of the fuel stream to the intake manifold would produce a reverse flow of fuel from the chamber back to the stream, thereby defeating the intended purpose of preventing excess liquid fuel from reaching the cylinders of the engine and resulting in efficiency losses and waste of fuel.

SUMMARY OF THE INVENTION

According to the invention herein, the incorporation of trailing edge scoops for flanges on the propeller blades produces a positive centrifuging action that the prior art propeller blades did not produce. Furthermore, by packing the collection chamber that receives the centrifuged liquid fuel with metallic wool or other types of fibrous reticular material forming an intricate interstitial network, reverse suction of liquid fuel from the collection chamber back into the fuel stream is substantially diminished or eliminated by virtue of the fact that the packing causes the liquid fuel to descend by capillary action and gravity into the well portion of the expansion chamber whence it is withdrawn intermittently or continuously.

The invention herein also includes improved auxiliary equipment to prevent reverse suction of liquid fuel from the collection chamber back to the fuel stream, in the form of a closed drain tank into which liquid fuel from the well of the collection chamber flows. By providing a closed drain tank, reverse suction from the collection chamber back to the fuel stream flowing to the intake manifold is prevented or appreciably reduced through the annular port between the propeller blade periphery and the collection chamber.

Additionally, provision is made for partially emptying the drain tank and transmitting recaptured fuel back to the main fuel supply tank or to the fuel supply system that is upstream relative to the carburetor only. This function may be performed, for example, by an electrically operated pump connected to the drain tank and which is activated by a liquid level switch when a predetermined quantity of fuel has been accumulated therein.

Furthermore, in the event that the atomized fuel stream passing to the intake manifold is too "thin," means are provided for restoring predetermined or desired quantities of liquid fuel back into the fuel stream for efficient operation of the engine. This mechanism is adjustable to produce the desired tuning of the engine.

Since the objective of the invention herein is to produce a lean, vaporized or atomized fuel stream to the engine, it may be necessary on some occasions to provide for surge power of the engine for very fast starts or for emergency passing, in which circumstances an enriched mixture of fuel is necessary to be transmitted to the engine. Accordingly, there is provided an automatic device that may be activated momentarily by the throttle pedal of the automobile to cause a demand quantity of liquid fuel to be restored to the fuel stream passing to the engine.

The system and apparatus herein is also useful in other contexts where liquid or other non-gaseous components are to be partially or wholly removed from gaseous streams containing excess liquid or fine particulate materials.

These and other novel features and advantages of the present invention will be described and defined in the following specification and claims.

BRIEF DESCRIPTION OF THE DRAWINGS

FIG. 1 is a side elevation of a schematic representation of a carburetor incorporating the present invention;

FIG. 2 is a top view of the apparatus shown in FIG. 1;

FIG. 3 is a greatly enlarged fragmentary sectional schematic view taken on line 3—3 of FIG. 2, some parts being shown in elevation and others in dotted outline, and including a schematic representation of an auxiliary backfire safety unit attached to the apparatus;

FIG. 6 is an enlarged central fragmentary portion of the propeller shown in FIG. 4, some parts being shown in section, some parts in elevation, and some parts broken away;

FIG. 9 is an enlarged schematic elevation of another embodiment of the propeller shown in conjunction with a portion of the expansion chamber;

FIG. 10 is a schematic top view of another embodiment of a propeller that may be utilized in the apparatus herein;

FIG. 11 is a schematic top view of a still further embodiment of a propeller that may be incorporated into the apparatus herein;

FIG. 12 is a fragmentary schematic view taken substantially on line 12—12 of FIG. 10; and FIGS. 12A, 12B, 12C and 12D are similar to FIG. 12, and schematically illustrate further variations in the embodiments of the propellers shown in FIGS. 3, 4, 5, 9, 10 and 11.

DESCRIPTION OF THE PREFERRED EMBODIMENTS

Figure 4:
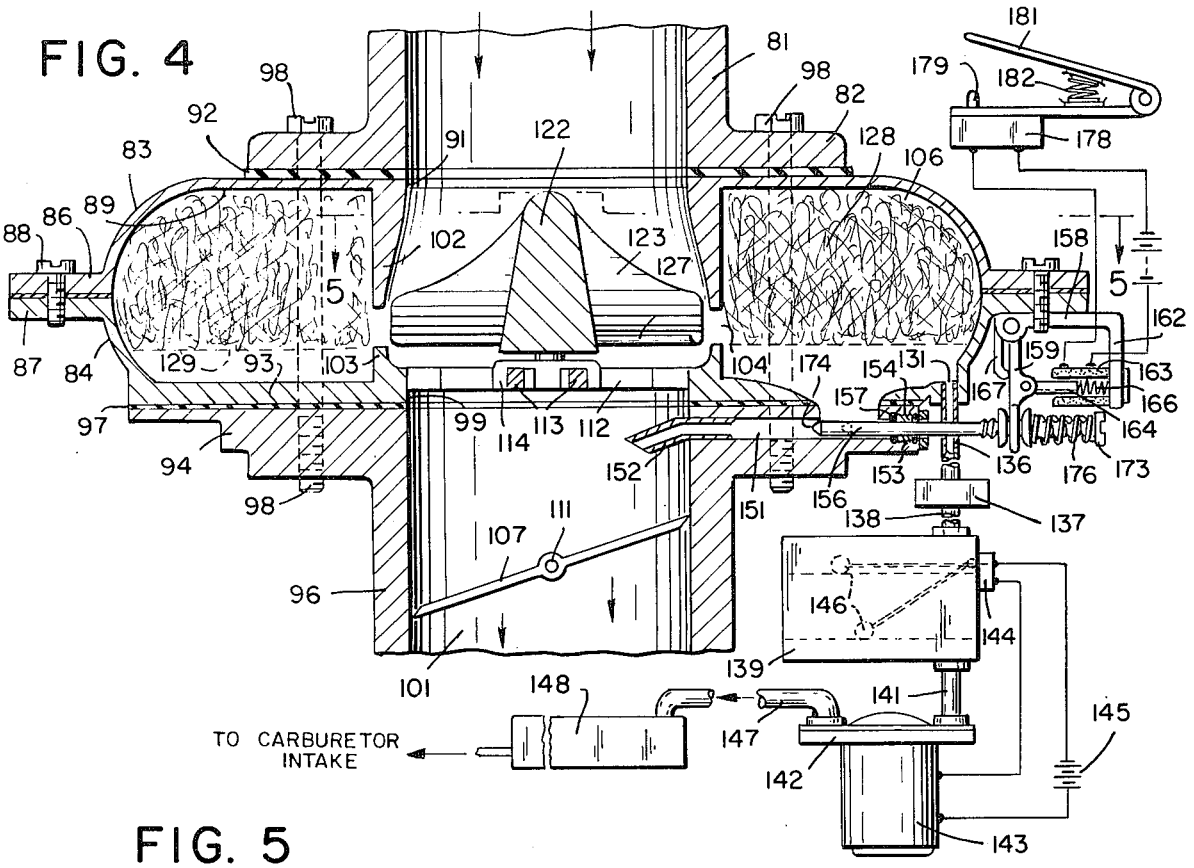
FIG. 4 is a fragmentary schematic vertical central section view of another embodiment of the invention herein, some parts being shown in elevation, some parts in dotted outline, as well as additional auxiliary apparatus connected therewith and shown partly in section, partly in elevation and partly schematically.

Referring now to the drawings in detail, the upper fragmentary portion of FIG. 1 illustrates the bottom portion of a conventional automobile gasoline engine carburetor 21 to which is connected one embodiment of the apparatus of the present invention, comprising a tube 22, the bottom of which terminates in an annular flange 23, with channel 24 of tube 22 conducting the fuel stream from carburetor 21. Connected to the bottom of annular flange 23 is a circular bell 26, the top of which has a central aperture 27 axially aligned with channel 24. The top horizontal surface of bell 26 is spaced apart from the bottom surface of flange 23 by means of a suitable ring gasket 28 forming a liquid and vapor tight seal. The outer portion of bell 26 is formed into a downwardly extending curved portion 29 which terminates in an integrally formed, outwardly extending flange 31.

A bottom bell 32 mates with bell 26 to form an annular liquid fuel trap or collection chamber 33. Bell 32 has an integrally formed annular flange 34 which is secured to flange 31 by means of spaced bolts 36. The horizontal floor of bell 32 has a central aperture 37 which is axially aligned with the circular channel 38 of tube 39 which has an upper, outwardly extending, integrally formed flange 41. Interposed between the bottom surface of bell 32 and the upper surface of flange 41 is a gasket 42 forming a liquid and vapor tight seal therebetween. Spaced bolts 43 extend through suitable apertures in flanges 23 and 41, gaskets 28 and 42, and bells 26 and 32, to secure the assembly of said component parts firmly together.

The bottom portion of tube 39 has an integrally formed, outwardly extending flange 44 which is secured to a suitable portion of the intake manifold 46 by means of a plurality of spaced bolts 47.

The center of the top wall of bell 26 has a short, annular, integrally formed, downwardly extending flange 48, the lower edge of which is located opposite and spaced apart somewhat from the upper edge of a corresponding upwardly extending annular flange 49 integrally formed with the bottom of bell 32. Together, flanges 48 and 49 of substantially equal diameter define an open central fuel passage 51 through bells 26 and 32 between carburetor 21 and the intake manifold 46 of the internal combustion engine.

In a lower portion of channel 38 there is mounted a conventional throttle-operated butterfly valve, not shown, for adjusting the flow of the fuel stream passing from the carburetor to the intake manifold of the engine. In some embodiments, the butterfly valve may alternatively be located in channel 24. A typical butterfly valve is illustrated schematically in another embodiment of the invention described hereinafter.

The respective spaced opposing edges of flanges 48 and 49 define an annular transit port 50 for the movement of liquid fuel from fuel passage 51 into chamber 33. In some embodiments, spaced narrow vertical support struts may be positioned between the lower edge of flange 48 and the upper edge of flange 49 to enhance the structural strength of said flanges surrounding fuel passage 51. In most embodiments, however, flanges 48 and 49 would be made of a sufficiently strong material so as to maintain their own structural integrity.

Located axially within passage 51 is a vertical, rotatable shaft 52, the upper portion of which has a rotatable hub 53 to which are connected the inner ends of a plurality of tilted propeller blades 54. The outer ends of said blades, which rotate with hub 53 and shaft 52, move in a circular path aligned with, but spaced apart from, transit port 50.

The upper end of shaft 52 terminates in a bearing 56 which cooperates with a suitable bearing seat in support block 57. Block 57 is supported by the inner ends of crossbars 58, the outer ends of which are mounted in the wall of the upper central aperture of bell 26. The lower end of shaft 52 terminates in a bearing 61 which cooperates with a suitable bearing seat in support block 62. Block 62 is supported by the inner ends of crossbars 63, the outer ends of which are mounted in the wall of the lower central aperture of bell 32.

Bearings 56 and 61, represented only schematically in FIG. 3, would, in actuality, be selected from any one of several types of bearings well known in the art that permit virtually free, passive low friction rotation of shaft 52, and free passive spinning of blades 54 when the latter are impinged by the stream of fuel passing downwardly from carburetor 21 through confined fuel passage 51. The selected bearings would, of course, be such as to be operative in, but protected from, the fuel stream.

The trailing edge or trailing portion of each blade 54 is provided with a flange 64 extending upwardly from the upper surface of said blade and forming a scoop which accumulates quantities of liquid components from the fuel stream and propels said components centrifugally and laterally outwardly through transit port 50 and into collection chamber 33. In the embodiment shown in FIG. 3, flange 64 tapers gradually from a wider dimension at the outer end of blade 54 to a narrow dimension or an apex at hub 53 at the inner end of blade 54.

If an ordinary propeller blade without a trailing edge flange or scoop were employed in the apparatus herein, it has been found that, in actuality, the major portion of the liquid components of the fuel stream nevertheless passes between the blades and reaches the intake manifold of the automobile engine. The provision herein of the flange or scoop 64 ensures that an appreciably significant portion and even the major quantity of liquid components are removed from the fuel stream passing through passage 51. Thus, the fuel mixture reaching the intake manifold is greatly, if not completely, depleted of liquid components that would otherwise be deleterious to the action of the internal combustion engine and wasteful of fuel. By depleting the fuel stream of liquid particles of fuel, there is realized a considerably increase in efficiency of the engine because appreciably less unburned fuel passes through the engine and out into the atmosphere to create conditions of pollution.

Although in some embodiments the provision of flanges 64 on propeller blades 54 brings about a considerable improvement in fuel economy and in engine efficiency, the efficiency of the apparatus herein is enhanced by including within collection chamber 33 a packing 66 of fibrous reticular, cellular, webbed or filamentary materials. Such materials may include metallic wool of steel, copper or suitable metallic alloys. The filamentary or fibrous material may include strands of natural or synthetic fibers, while the cellular material may consist of porous ceramic, or natural or synthetic substances. All of these materials would have the properties of trapping liquid droplets and permitting the latter to descend by capillary action and gravity to the bottom of chamber 33. The density of the packing 66 will be determined by considerations of reducing or eliminating turbulence within the collection chamber, and of the capability of the materials in trapping the liquid droplets and preventing them from being sucked back through the transit port into the fuel system. The reticular interstices between the metallic or fibrous strands would also be large enough to permit the descent of the trapped liquid fuel by gravity toward the bottom of the collection chamber. In the case of a ceramic mass or block, there should be easy gravity flow through the pores of such a block so that clogging and static retention of the liquids would be obviated. By virtue of this packing in the form of an intricate interstitial network, turbulence within chamber 33 is greatly damped, thereby reducing the possibility of reverse suction of liquid fuel from chamber 33 into fuel passage 51.

Liquid fuel entering through transit port 50 into chamber 33 impinges upon and is captured by packing 66 and through which it descends by capillary action and gravity to the floor of said chamber which contains an outlet port 67 through which the liquid fuel is drained from chamber 33. Suitable means may be provided by way of tube 68 to return the liquid fuel back to the main fuel tank of the engine. In some embodiments, a backfire safety unit 69 may be included in the fuel return line 68, said unit taking the form of box or cylinder which may be provided with a suitable reticular packing so that any accidental ignition of fuel in chamber 33 would be choked off by unit 69 and prevented from continuing through fuel return line 68.

In FIG. 9, there is shown an alternative embodiment of the propeller wherein each of the propeller blades 71 has a trailing edge flange or scoop 72, the latter having a uniform curvature and dimension along the entire length of the propeller blade and terminating at the hub 73 of propeller shaft 74.

While FIG. 10 illustrates a schematic top view of the propeller shown in FIG. 3, with the tapering flange 64, FIG. 11 illustrates an alternative embodiment of a flange 76 which extends only partially along the trailing edge of propeller blade 77. Depending upon the multifarious variables that obtain in carburetion and in the operation of internal combustion engines, the shape and size and the longitudinal dimension of the various flanges or scoops shown in the foregoing emboidments may be varied empirically in order to achieve optimum operation with the same basic and necessary function of performing the centrifugal action upon the liquid components of the fuel stream to cause their projection into trap or collection chamber 33.

While FIG. 12 shows an edge view of the flange in the embodiment shown in FIG. 10, the shape of said flange may be varied in accordance with the alternative illustrations in FIGS. 12A, 12B, 12C and 12D, in order to provide the optimum efficiency of centrifugal action upon the liquid fuel by the propeller blade flanges.

The optimum form of the propeller blade flanges or scoops will be established in conjunction with other dimensional, pitch and curvature variations of the propeller blades and other operational considerations determined by the other components of the system herein.

An alternative embodiment of the invention herein is illustrated in FIGS. 4, 5, 6, 7 and 8, together with the inclusion of auxiliary equipments to augment the function of the apparatus herein. In this embodiment, carburetor 21 has a downstream tube 81 terminating in an integrally formed, outwardly extending annular flange 82. The liquid fuel trapping or collecting apparatus is contained in an upper bell 83 and a lower bell 84 whose respective integrally formed, outwardly extending annular flanges 86 and 87 are secured together by means of a plurality of spaced bolts 88. A suitable leakproof annular gasket (not shown) may be interposed between flanges 86 and 87. The horizontal roof 89 of bell 83 has a central aperture 91 which coincides with the interior fuel passage of tube 81. Juxtaposed between roof 89 and flange 82 is a suitable leak-proof gasket 92.

Horizontal floor 93 of bell 84 rests upon the annular, outwardly extending flange 94 of a downflow tube 96 connecting to the intake manifold of the automotive engine. Interposed between the bottom surface of floor 93 and the upper surface of flange 94 is a suitable leakproof gasket 97. Extending through suitable apertures in flanges 82 and 94, through gaskets 92 and 97, and through roof 89 and floor 93, are spaced bolts 98 which secure the assembly of said parts firmly together.

Floor 93 of bell 84 has a central circular aperture 99 which coincides axially and dimensionally with the central aperture 101 of tube 96. Surrounding aperture 91, roof 89 of bell 83 has an integrally formed, downwardly extending annular flange 102, while surrounding aperture 99 floor 93 of bell 84 has an upwardly extending integrally formed annular flange 103, the bottom circular edge of flange 102 being somewhat spaced apart from the upper circular end of flange 103 to define an annular transit port 104 for movement of liquid fuel into collection chamber 106 defined by bells 83 and 84. The opposing spaced edges of flanges 102 and 103 are substantially equal in diameter, while the interior walls of said flanges may be curved or sloped if desired or necessary in any manner to obtain optimum flow of the fuel stream from the carburetor to the intake manifold.

Pivotally mounted within aperture 101 of tube 96 is a conventional butterfly valve 107 for controlling the fuel stream passing to the intake manifold. The butterfly valve may alternatively be pivotally mounted within the central passage of tube 81, depending upon various operational and structural conditions that are to be met by the apparatus herein and in order to work effectively in conjunction with other functions of the engine. The butterfly valve 107 is operated in the usual manner by the external control rod 108 (FIG. 1) and lever 109 connected by suitable means to the pivot shaft 111 of valve 107.

Mounted securely in the wall of central aperture 99 of floor 93 is a pair of crossbars 112 and 113 in cruciform array. In the center hub 114 formed between said crossbars is firmly mounted the lower end of a shaft 116. See also FIG. 6. Shaft 116 extends axially upwardly between flanges 102 and 103. At its lower portion, shaft 116 has an annular shoulder 117 which supports a thrust bearing 118 upon which is rotatably mounted an upwardly extending sleeve 119 freely rotatable around a reduced diameter portion of stationary shaft 116. Mounted on the top of sleeve 119 is a rotatable ball bearing 121.

Removably mounted on the assembly of thrust bearing 118, sleeve 119 and bearing 121, is hub 122 of a propeller having radially extending propeller blades 123. Hub 122 has a central aperture 124 which accommodates with a close slide fit bearings 121 and 118, said aperture 124 having an inwardly extending shoulder 126 which rests upon the outer race of bearing 121. The upper end of aperture 124 terminates in an upwardly extending axially aligned recess which accommodates the upper end portion of shaft 116 around which it freely rotates. Hub 122, together with its blades 123, may be easily lifted and removed for replacement or adjustment.

The mounting of propeller hub 122 is arranged to permit the free and rapid spinning of the propeller when blades 123 are subjected to the kinetic forces of the fuel stream that pass downwardly from tube 81 to tube 96.

Propeller blades 123, which are suitably pitched for their required function, are also each provided with a trailing edge centrifuging flange or scoop 127, said blade and said flange being shaped in accordance with the structural and functional requirements suggested and described hereinbefore in connections with FIGS. 3, 9, 10, 11, and 12-12D. Here, also, in the embodiment of FIG. 4, collection chamber 106 contains a packing 128 made of retiform or reticular material such as metallic wool or the like, similar to and performing the same functions as the packing 66 described hereinbefore in connection with FIG. 3.

While the transit port 50 in FIG. 2 is shown located in the upper portion of the liquid trap apparatus, the transit port 104 in FIG. 4 is located towards the bottom of chamber 106 and opposite the outer portions of blades 123 to receive the centrifuged liquid fuel propelled therethrough by means of flanges 127. The optimum levels, heights and widths of respective transit ports 50 and 104 may be determined empirically in conjunction with the dimensional and operating characteristics of the other related components of the apparatus. The fuel flow passage within flanges 102 and 103 (FIG. 4) may be modified by appropriate internal curvatures for optimizing the action of the propeller flanges 127. Said curvatures may be determined empirically on the basis of the operational characteristics of the entire carburetor and engine system.

It is also contemplated that an annular mesh or screen ring 129 may be located horizontally in chamber 106 spaced apart somewhat from the botton floor thereof and operating to support the mass of the packing 128 to facilitate drainage of liquid fuel from chamber 106.

While it might appear that the energy of the fuel stream passing to the intake manifold would exert forces against scoops or flanges 64, 72 and 127 of the respective propeller blades that would be thought to cause resistance to the normal spinning direction of the propellers, it is to be noted that the aggregate energy received by the tilted blade surfaces exceed that resistance by a wide margin. Thus, in actual operation, the propellers spin quite rapidly and exert sufficient power to cause centrifugation of considerable quantities of liquid fuel by means of the flanges or scoops into the respective collection chambers.

The present invention comprehends within its purview all equivalent scoop means on a rotating element located in the path of and spun by the fuel stream passing from the carburetor to the intake manifold of the engine. The element is rotated by the forces of the fuel stream from which liquid components are caught by said scoops and ejected centrifugally from the stream into a surrounding collection chamber.

The spinning element may take any one of several forms where there are provided energy receiving components, such as blades or fins, or the like, for spinning the element, and flanges or scoops connected to said element and which move in the same direction of said energy receiving components. Said scoops or flanges capture liquid components from the fuel stream and project them centrifugally out of the path of the fuel stream. In all such equivalent embodiments, the kinetic forces of the rapidly moving fuel stream would effectively cause rapid rotation of the spinning element as well as supply sufficient work energies to cause centrifugal ejection of the liquid components by the flanges or scoops through the respective transit ports located in suitable positions opposite the outer portions of said flanges or scoops to effectuate transfer of said components into the respective collection chambers.

Chamber 106 of FIG. 4 may be emptied of liquid fuel in the same manner as chamber 33 of FIG. 3. In the embodiment of FIG. 4, however, the drainage system is modified in order to accommodate the apparatus to fuel mixture adjustment and to surge power requirements.

Figure 5:
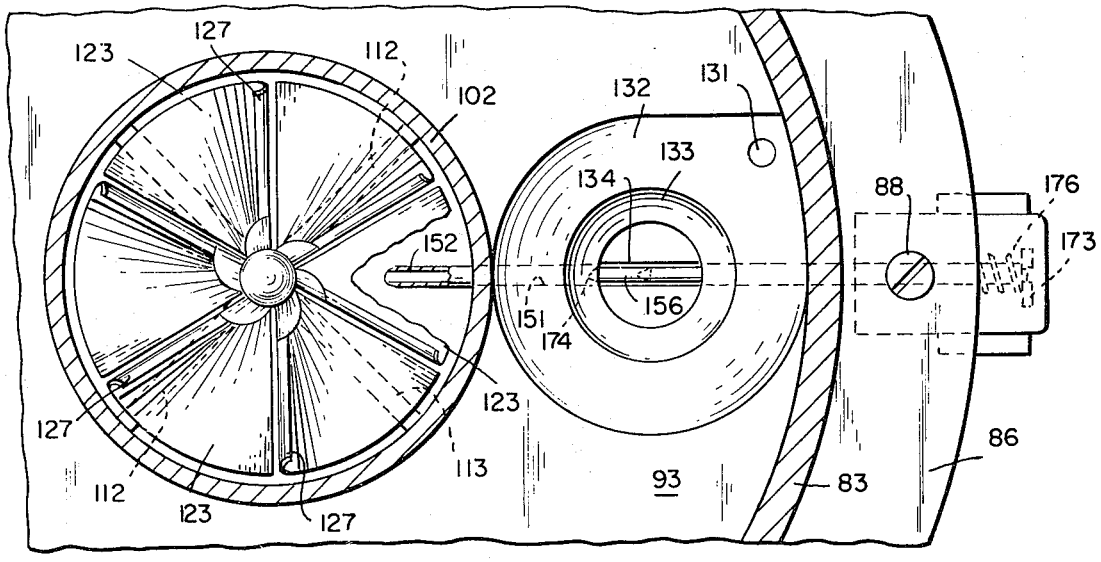
FIG. 5 is an enlarged fragmentary view taken on line 5—5 of FIG. 4, some parts being omitted.
Figure 7:
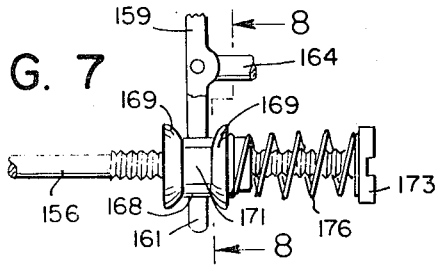
FIG. 7 is an enlarged fragmentary view of a portion of the apparatus shown in FIG. 4.
Figure 8:
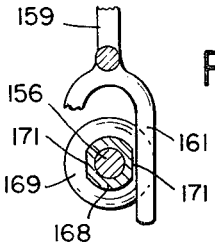
FIG. 8 is a fragmentary view taken on line 8—8 of FIG. 7.

As shown in FIGS. 4 and 5, chamber 106 has a drain outlet 131 that is located at a level somewhat above that of floor 93 of bell 84 whereby a small pool of trapped fuel is accumulated in a well 132 formed by a suitable depression in floor 93. Located substantially in the center portion of well 132 is a lower depression 133, in the bottom of which is formed a longitudinal slot 134 through which a secondary drainage of accumulated liquid fuel may take place.

For normal drainage through aperture 131, the liquid fuel passes through tube 136, thence through optional backfire safety unit 137 comparable in structure and function to unit 69 in FIG. 3. From safety unit 137, the drained liquid fuel passes by way of tube 138 into drain tank 139 which maintains a closed system that prevents the Venturi action of the rapidly moving fuel stream from producing reverse suction of liquid fuel from collection chamber 106 back through transit port 104 into said stream. Drain tank 139 is partially emptied when necessary, from time to time, through outlet tube 141 by means of pump 142 driven by an electric motor 143.

Located in drain tank 139 is a liquid level sensing element which operates an electric switch 144 connected into the electrical circuit that operates motor 143 by means of power source 145. The liquid level sensing element may take the form of a ball float 146 which is pivotally connected to the on-off mechanism in switch 144. When float 146 is at a predetermined low level, switch 144 is in the open condition; whereas, when float 146 rises to a predetermined high or maximum level, it closes switch 144 thereby starting the action of pump 142 to cause the emptying of drain tank 139 to a point where the liquid level is lowered to the predetermined minimum quantity of liquid fuel in said tank necessary to preserve the closed condition of the system.

While the liquid level descends, float 146 moves downward pivotally until the predetermined low minimum level has been reached, at which time switch 144 opens the electric circuit controlling pump 142 which then stops operating. While tank 139 is filled up with drainage from collection chamber 106 and float 146 is rising, switch 144 remains in the open circuit condition until float 146 reaches the predetermined maximum level at which time switch 144 closes the circuit again and causes pump 143 to repeat the partial emptying of tank 139 and to return the recovered liquid fuel through tube 147 only to the main fuel supply tank or the fuel supply system 148 to which the upstream intake of carburetor 21 is connected by conventional means known in the art. Other types of liquid level sensors other than ball floats may be utilized to operate switch 144 at suitable maximum and minimum levels.

Other equivalent expedients may be utilized for draining tank 139 from time to time, such as by a fluid level or pressure responsive valve outlet located somewhat above the floor of said tank and being operative when the liquid reaches a predetermined maximum level to open and permit emptying of said liquid until a minimal reserve quantity is retained therein in order to maintain the required closed sytem. Such a valve would be connected by suitable means to the fuel supply tank of the engine.

Mechanisms are also incorporated with the apparatus herein to restore liquid fuel into the fuel stream passing to the intake manifold for the separate operational conditions of fuel enrichment and surge requirements.

For fuel enrichment, there are provided adjustable means to permit continual restoration of a predetermined or controlled quantity of liquid fuel to the fuel stream when a fine adjustment for optimum operation of the engine is required. Accordingly, flange 94 of tube 96 contains a horizontal aperture 151 aligned longitudinally and communicating with slot 134 whereby liquid fuel in chamber 106 can flow into said aperture. The inner end of aperture 151 accommodates the inner portion of a small nozzle tube 152, the outer portion of which projects somewhat into aperture 101 where the fuel stream passes downstream from the propeller to the intake manifold. Located in flange 94 at the outer end of aperture 151 is a sleeve 153 having a central aperture 154 which slidably accommodates the shank of pin 156, said sleeve having a pair of spaced O-rings 157 which provide a leak-tight seal between said sleeve and said pin.

Secured to flange 87 by means of bolt 88 is a horizontal bracket 158 to which is pivotally connected a downwardly extending lever arm 159, the lower end of which terminates in a pair of downwardly extending spaced tines 161. Bracket 158 has an integrally formed, downwardly extending arm 162 on which is mounted solenoid 163, having an armature 164 whose outer end is pivotally connected to an intermediate portion of lever arm 159. Solenoid spring 166 normally urges armature 164 outward from solenoid 163 thereby normally urging lever arm 159 against downwardly extending stop element 167 formed integrally with bracket 158 thereby limiting the leftward movement of tines 161.

Located between tines 161 is an internally threaded nut 168, the forward and rearward portions of which have integrally formed flanges 169, the opposing faces of which are curved to permit free movement of tines 161 during the pivoting action of arm 159. Nut 168 has a pair of parallel vertical external flats 171 near which the respective inner surfaces of tines 161 are located thereby preventing rotation of said nut. A portion of pin 156 is threaded for engagement with nut 168 while the outer end of said pin has a slotted screw head 173 which accommodates a tool for rotating said pin and adjusting the position of its inner conical valve head 174 relative to the valve seat formed by the juncture between the forward end of slot 134 and aperture 151. Thus, the location of valve head 174 can be adjusted to predetermine the quantity of liquid fuel that will flow outwardly through aperture 151 and tube 152 into the fuel passage downstream from the centrifuging propeller.

When valve head 174 is in the closed position shown in FIG. 4, passage of liquid fuel through aperture 151 and nozzle 152 is prevented. The dotted lines on pin 156 are indicative of a slightly retracted location of valve head 174. A coil spring 176 surrounding pin 156 is located between screw head 173 and rear flange 169 in order to provide sufficient tension for preventing lost motion and to secure the adjusted position of pin 156. By these means, the apparatus herein can be "tuned" to determine the desired or required richness or leanness of the fuel supply passing into the intake manifold of the engine.

Under varying driving conditions encountered on the highway, it is often necessary for the automotive engine to have momentary surge power for emergency fast starts or for passing other vehicles, or in other stress circumstances which would require a considerably richer fuel supply that would normally be passed to the intake manifold of the engine. In order to accommodate the apparatus to such exigencies calling for surge power, the apparatus is provided with auxiliary components and equipments that will accommodate it to those extreme demand circumstances.

When surge or demand power is required, solenoid 163 can be operated to retract valve head 174 by a considerable distance in order to permit a greater than usual flow of liquid fuel through aperture 151 and through nozzle 152 in order to enrich the fuel stream passing to the intake manifold. The energization of solenoid 163 causes the retraction of armature 164 against the action of spring 166 thereby automatically causing the outward pivoting action of lever arm 159. Consequently, tines 161 bearing against the rear flange 169 causes the simultaneous retraction of pin 156 and its valve head 174 to permit the greater flow of liquid fuel out through tube 152. The power source 177 for solenoid 163 may be activated by a switch 178, the actuator button 179 of which is operated by pivoting throttle pedal 181 normally urged into its retracted position by spring 182. The upper end of button 179 is adjustably located in a suitable position for actuation by throttle pedal 181 when the latter is pivotally depressed to a degree when surge power or exceptionally high speed operation of the engine is required or necessary. The solenoid action is independent of the adjustable means on pin 156.

It is contemplated that the auxiliary equipments illustrated and described in connection with the embodiment shown in FIG. 4 may also be incorporated into the embodiment of the invention illustrated and described in connection with FIG. 3.

Where the word "reticular" is recited in the accompanying claims, its meaning subsumes all suitable types of fibrous, filamentary, webbed, cellular and porous materials that can perform the function of collecting and retaining the liquid components within the collection chamber and permitting drainage thereof by capillary action and gravity toward the bottom of said chamber. It is also contemplated that the reticular packing may comprise a plurality of stationary flat or curved spaced fins arrayed radially or horizontally within the collection chamber, said fins being either perforated, serrated, corrugated, or otherwise suitably shaped to perform the requisite trapping and draining functions.

Although the present invention has been described with reference to particular embodiments and examples, it will be apparent to those skilled in the art that variations and modifications can be substituted therefor without departing from the principles and true spirit of the invention. The 'Abstract" given above is for the convenience of technical searchers and is not to be used for interpreting the scope of the invention or claims.

We claim:

1. A fuel reclaiming system for an internal combustion engine including a carburetor a fuel supply system connected to the upstream intake of the carburetor, an intake manifold on the engine, and a tubular structure forming a fuel passage between said carburetor and said manifold for conducting the fuel stream therebetween, comprising an enclosure forming a collection chamber located externally of said tubular structure and communicating with said passage, a propeller mounted in said passage in the path of and spun by the movement of said fuel stream, a flange on the trailing edge of the blades of said spinning propeller for catching at least a portion of the liquid components of said fuel stream and centrifugally projecting said liquid components into said collection chamber, a drain tank, a connection between said collection chamber and said drain tank for continuously draining said liquid components from said collection chamber into said drain tank, said drain tank forming a continuously closed system with said collection chamber for counteracting reverse flow of said liquid components from said collection chamber back into said fuel stream, the output of said drain tank being connected only to said fuel supply system.

2. The system according to claim 1 and further comprising means in said drain tank for periodically partially emptying said drain tank of liquid components while retaining at least a minimum quantity of liquid in said drain tank to preserve the closed system existing between said drain tank and said collection chamber.

3. The system according to claim 1 and furthr comprising a packing of reticular material in said collection chamber for retention and drainage of said liquid components therein.

4. The system according to claim 1 and further comprising a valve mechanism connected to said drain tank for partially emptying said drain tank of limited quantities of liquid components while continuously preserving the closed system existing between said drain tank and said collection chamber.

5. The system according to claim 4 and further comprising liquid level sensing means mounted in said drain tank responsive between predetermined maximum and minimum liquid levels in said tank to control the operation of said valve mechanism.

6. The system according to claim 1 and further comprising an adjustable valve connected between said collection chamber and a location in said fuel passage downstream from said propeller for returning a predetermined quantity of liquid from said collection chamber back to said fuel passage.

7. The sytem according to claim 6 and further comprising means connected to said adjustable valve and operative independently by the operator of the engine at will upon said adjustable valve to restore greater quantities than said predetermined quantity of liquid to said fuel passage when surge operation of said engine is required.

8. The system according to claim 1 and further comprising a first drain outlet in said collection chamber connected to said drain tank, a second drain outlet in said collection chamber located at a level lower than the first mentioned outlet, said second outlet communicating directly with said stream downstream from said propeller and an adjustable valve between said second drain outlet and said fuel stream for controlling the quantity of liquid that drains from said second outlet into said stream.

9. The system according to claim 8 wherein said adjustable valve is movable independently of its adjustment means to provide under demand conditions greater than normal return of fluid through said second outlet, and further comprising an actuator connected to and moving said valve under said demand conditions, and throttle means connected to and operating upon said actuator when said greater than normal demand conditions exist.

10. The system according to claim 9 wherein said adjustable valve comprises an elongated pin, a valve head on said pin, and a threaded nut, said pin being threadably rotatable with said nut for adjustably determining the location of said valve head relative to said second outlet.

11. The system according to claim 10 and further comprising a solenoid mounted near said nut, a pivotable bracket on which said nut is mounted, the armature of said solenoid being connected to said bracket, a normally open electrical circuit connected to and actuating said solenoid, the closing of said circuit causing said armature to retract said nut for a distance greater than normal for providing demand flow of liquid through said second outlet.

12. The system according to claim 11 and further comprising a switch in said electrical circuit for opening and closing the latter and a throttle control connected to said switch, said control being operative upon said switch only when the demand flow of liquid is to pass through said second outlet.

13. A fuel reclaiming system for an internal combustion engine including a carburetor a fuel supply system connected to the upstream intake of the carburetor, an intake manifold on the engine, and a tubular structure forming a fuel passage between said carburetor and said manifold for conducting the fuel stream therebetween, comprising an annular enclosure forming a collection chamber externally surrounding said tubular structure and communicating with said fuel passage, a propeller mounted in said passage in the path of said fuel stream, a flange on the training edge of each of the blades on said propeller, said flanges being shaped to capture at least a portion of the liquid components of said fuel stream and to project said captured liquid components centrifugally into said collection chamber when said propeller is rotated by the motion of said fuel stream, a drain tank connected to said collection chamber from which said liquid components drain continuously into said drain tank, at least some of said liquid components always being retained in said drain tank to form a continuously closed system with said collection chamber and to counteract tendency of reverse flow of liquid components from said collection chamber into said fuel stream the output of said drain tank being connected only to said fuel supply system.

14. The system according to claim 13 and further comprising a mechanism connected to said drain tank for only partially emptying said drain tank of limited quantities of liquid components while preserving the closed system existing between said drain tank and said collection chamber, said emptied liquid components being transmitted to the fuel supply system of the engine.

15. The system according to claim 14 and further comprising a liquid level sensor mechanism connected to said first mentioned mechanism, said sensor being operative to maintain a minimal quantity of liquid components in said drain tank for preserving the closed system of said tank with said collection chamber.

16. The system according to claim 13 and further comprising a reticular packing in said collection chamber for facilitating the retention and drainage of centrifuged liquid components in said collection chamber for subsequent drainage into said drain tank.

17. A fuel reclaiming system for an internal combustion engine including a carburetor a fuel supply system connected to the upstream intake of the carburetor, an intake manifold on said engine, and a tubular structure forming a fuel passage between said carburetor and said manifold for conducting the fuel stream therebetween, comprising first means located externally of said tubular structure and communicating therewith for receiving liquid components from said fuel stream, second means mounted in said tubular structure in the path of said fuel stream, the force of the movement of said fuel stream from said carburetor to said manifold causing liquid components in said fuel stream impinging upon said second means to be centrifugally projected into said first means, third means connected to said first means for continuously receiving said liquids from said first means, said third means and said first means together forming a continuously closed system which counteracts reverse flow of liquids from said first means back into said fuel stream and fourth means connected between said third means and said fuel supply system for periodically only partially emplying liquids from said third means and transmitting them only to said fuel supply system.

18. The system according to claim 17 and further comprising fifth means contained within said first means for facilitating the retention of liquid components therein and the draining of said liquid components therefrom into said third means.

* * * * *

UNITED STATES PATENT OFFICE

CERTIFICATE OF CORRECTION

PATENT NO. : 3,942,500

DATED : March 9, 1976

INVENTOR(S) : Ronald E. Koehm and Dante Fabbri

It is certified that error appears in the above-identified patent and that said Letters Patent are hereby corrected as shown below:

Column 5, line 4, change "considerably" to --considerable--

Column 5, lines 27-28, change "system" to --stream--

Column 5, line 68, change "emboidments" to --embodiments--

Column 6, line 36, change "connecting" to --connected--

Column 7, line 40, change "connections" to --connection--

Column 11, line 33, after "carburetor" insert a comma

Column 12, line 44, after "rotatable" change "with" to --within--

Column 12, line 63, after "carburetor" insert a comma

Column 13, line 4, change "training" to --trailing--

Column 13, line 17, after "stream" insert a comma

Column 14, line 5, after "carburetor" insert a comma

Column 14, line 26, change "emplying" to --emptying--

Signed and Sealed this

*twenty-ninth* Day of *June 1976*

[SEAL]

*Attest:*

RUTH C. MASON
*Attesting Officer*

C. MARSHALL DANN
*Commissioner of Patents and Trademarks*